US005230681A

United States Patent [19]

Hannum et al.

[11] Patent Number: 5,230,681

[45] Date of Patent: Jul. 27, 1993

[54] SINGLE LEG INCENTIVE PEDAL EXERCISER

[76] Inventors: Michael L. Hannum, 5328 James Ave. South, Minneapolis, Minn. 55419; Edward A. Hannum, 13516 Frederick Ave., Omaha, Nebr. 68144

[21] Appl. No.: 931,580

[22] Filed: Aug. 17, 1992

[51] Int. Cl.[5] ..... A63B 21/02

[52] U.S. Cl. ..... 482/121; 482/80; 482/124; 482/908; 602/27

[58] Field of Search ..... 482/79, 80, 121, 124, 482/127; 602/16, 27, 28, 29; 128/80 E, 80 F, 80 H

[56] References Cited

U.S. PATENT DOCUMENTS

| | | | |
|---|---|---|---|
| 2,567,195 | 9/1951 | Ellery | 602/28 |
| 4,371,161 | 2/1983 | Williams | 482/79 |
| 4,554,913 | 11/1985 | Womack et al. | 602/16 |
| 4,573,678 | 3/1986 | Lamb et al. | 482/80 |
| 4,834,078 | 5/1989 | Biedermann | 602/27 |
| 4,869,499 | 9/1989 | Schiraldo | 482/79 |
| 4,962,760 | 10/1990 | Jones | 602/27 |

*Primary Examiner*—Richard J. Apley
*Assistant Examiner*—Jeanne M. Mollo
*Attorney, Agent, or Firm*—Palmatier, Sjoquist & Helget

[57] ABSTRACT

A foot exerciser for engagement with the lower leg and foot that provides for resistance to swinging of the foot to exercise the foot. The foot exerciser includes a cradle for engaging the lower leg between the ankle and the knee and a pedal for engaging the foot. The pedal is swingably connected to the cradle with a tension arrangement to provide for swinging resistance. The foot exerciser is tailored to fit the foot and lower leg such that it may be used by the bed or wheelchair-ridden patient, or ambulatory patient.

14 Claims, 1 Drawing Sheet

SINGLE LEG INCENTIVE PEDAL EXERCISER

BACKGROUND OF THE INVENTION

The present invention relates to exercising apparatus, specifically an ankle and foot exercising apparatus to 1) promote dorsi and plantar flexion of the foot and 2) strengthening of the ankle, foot, and gastrocnemius (calf) muscle.

Dorsi and plantar flexion of the foot promotes contraction and relaxation of the gastrocnemius (calf) muscle which has a milking effect on the veins of the lower leg propelling blood forward. This prevents stasis of blood and the development of a thrombus (clot) which can then become dislodged (embolize) and become trapped in the lung (embolism). This can result in significant morbidity and mortality.

Patients who are immobile and confined to bed or wheelchair are at great risk for the development of stasis, as are individuals confined to prolonged sitting, as for example, on a long trip.

The present invention which utilizes a pedal action of the foot with incremental resistance increases the circulation in the legs to reduce the risk of thrombus formation and possible pulmonary embolism.

Foot exercises are also important for joint rehabilitation and strengthening the muscles of the foot and lower leg. The invention would then be beneficial in helping patients regain ambulation following injury or prolonged immobility.

SUMMARY OF THE INVENTION

An object of the present invention is to provide a foot exerciser that may be used by bed or wheelchair-ridden patients.

Another object of the present invention is to provide a foot exerciser that may be portable. The ambulatory patient may use the exerciser both in bed and when sitting, or in other positions during convalescence.

A feature of the present invention is the provision in a foot exerciser having a cradle for engaging the lower leg and a pedal for engaging the foot, of tension means between the cradle and pedal for creating resistance to a swinging of the pedal such that the foot may be exercised by a resistance pedaling of the foot.

Another feature is the provision in such a foot exerciser, of the tension means being biased to draw the pedal toward the cradle such that resistance is created when the foot is pedaled away from the knee.

Another feature is the provision in such a foot exerciser, of the tension means being variable to vary the resistance to the swinging of the pedal.

Another feature is the provision in such a foot exerciser, of the cradle and pedal being snappable together to provide for simple assembly.

Another feature is the provision in such a foot exerciser, of the pedal being relatively thin and lying relatively close to the foot such that the foot exerciser takes a form similar to a sandal and may be left on the foot when the patient is moved.

An advantage or the present invention is that it may be used in bed or in a wheelchair.

Another advantage is that it is simple to fabricate, assemble and operate.

Another advantage is that it is relatively inexpensive.

Another advantage is that it is comfortable to wear.

Another advantage is that it is simple to put on and take off. The structure of the invention permits the patient easy entrance to and exit from the device. The cradle and pedal are readily accessible for placement of the leg and foot therein.

Another advantage is that it permits the ankle to articulate naturally with out forcing the foot into unnatural or awkward positions.

Another advantage is that a cognitive response is provided by the tension means to encourage compliance with a physician's prescription.

Another advantage is that the foot exerciser engages only one leg such that the legs may be exercised independently of each other or such that only one leg need be exercised.

DESCRIPTION OF THE PREFERRED EMBODIMENT

Figure 1:
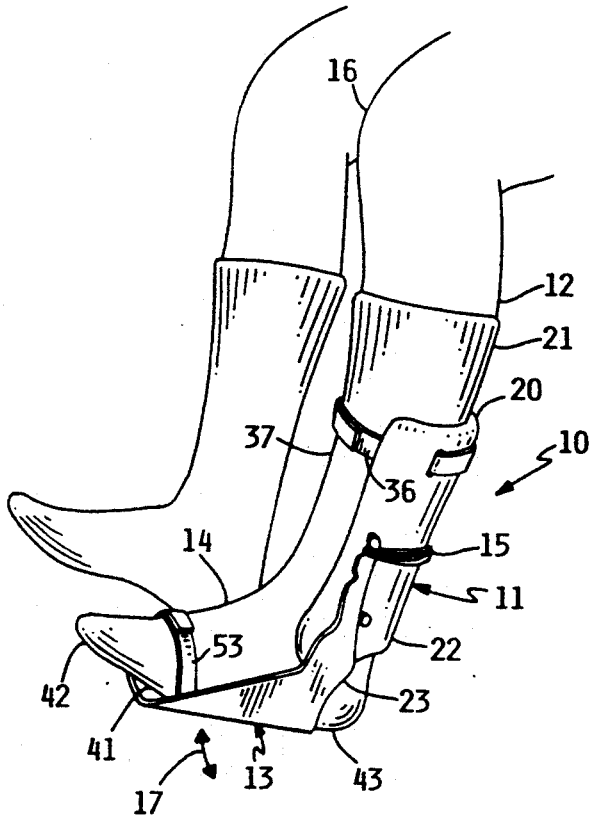
FIG. 1 is an environmental view showing the present foot exerciser on a lower leg and foot.

As shown in FIG. 1, the present single leg incentive pedal exerciser or foot exerciser 10 includes a lower leg cradle 11 for engaging a lower leg 12 and a foot pedal 13 for engaging a foot 14. The pedal 13 is swingably engaged to the cradle 11, and a flexible resilient element or tension means 15 engaged to both the pedal 13 and the cradle 11 creates resistance to the swinging of the pedal 13 such that the foot 14 may be exercised by a downward pedaling of the foot 14 relative to the knee 16 such as indicated by arrow 17.

Figure 2:
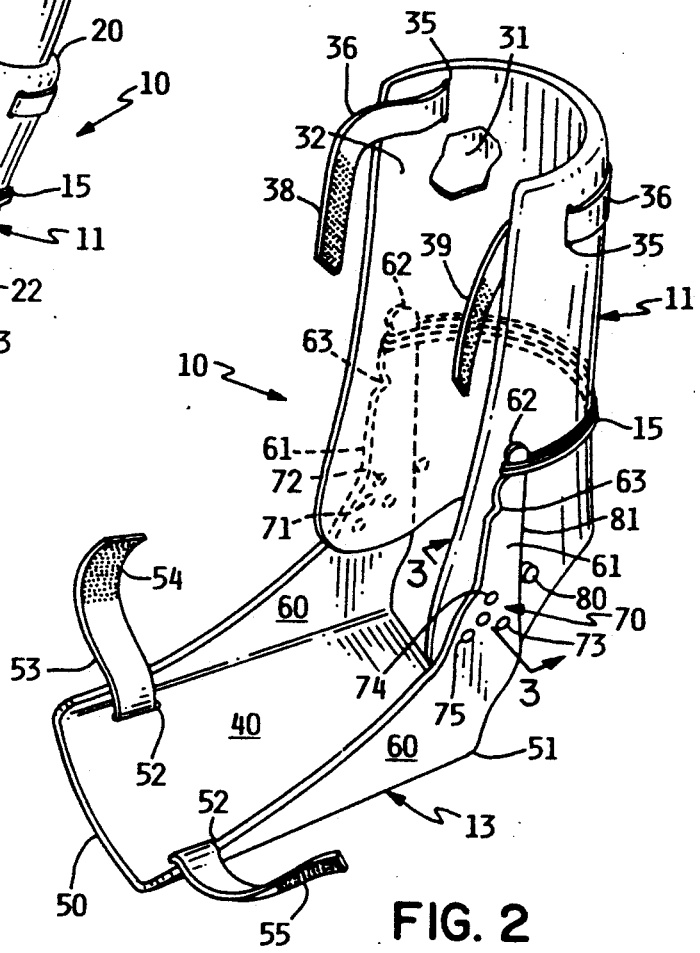
FIG. 2 is a detailed, perspective, partially broken away and phantom view of the foot exerciser of FIG. 1.
Figure 3:
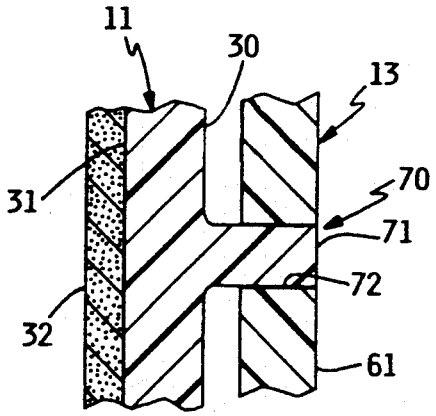
FIG. 3 is a section view at line 3—3 of FIG. 2 showing the snap, pivot connection between the leg cradle and the foot pedal of the foot exerciser.

As shown in FIGS. 1, 2, and 3, the leg cradle 11 is elongate and generally semicircular in section to be tailored to fit the lower leg 12. The leg cradle 11 includes an upper end 20 disposed generally adjacent to the lower portion of the calf muscle 21, and a lower end 22 disposed generally adjacent to and immediately above the ankle 23.

As shown in FIG. 3, the cradle 11 further includes an outer surface 30 and an inner surface 31. A closed cell foam padding 32 overlies the inner surface 31 to provide cushioning for the lower leg 21.

The upper end 20 of the cradle 11 includes a pair of transversely opposing slots 35 for receiving a strap 36 for engaging the shin 37 of the lower leg 12. The strap 36 preferably confronts a rear portion of the outer surface 30 as shown in FIG. 2. On strap end 38 includes a hook type material and another strap end 39 includes a loop type material; such material may be marketed under the Velcro® trademark. The lower end 22 of the cradle 11 is held relatively closely to the ankle 23 of the lower leg 12 by virtue of its connection to the pedal 13.

The pedal 13 includes a relatively thin ball engaging portion or sole 40 for primarily engaging the ball 41 of the foot 14. The ball engaging portion 40 typically extends from immediately behind the toes 42 to immediately forwardly of the heel 43. Such a length and thickness also permits an unhindered swinging of the pedal 13 relative to the cradle 11. The cradle 11 and pedal 13 may be formed of injection molded plastic or acrylic sheets.

The pedal 13 further includes front and rear ends 50 and 51. The front end 50 includes a pair of transversely opposed slots 52 for receiving a strap 53 which extends under the ball engaging portion 40. The strap 53 includes a hook-type material on one end 54 and a loop-type material on the other end 55 for fastening the strap 53 and pedal 13 to the foot 14. Such hook and loop material may be marketed under the trademark Velcro®.

The pedal 13 further includes a pair of integral sidewalls 60 disposed transversely of each other for minimizing sideways movement of the foot 14. At the rear end 51 of the pedal 13, the sidewalls 60 lead integrally into respective upwardly extending leverage arms 61 disposed transversely of each other. Each of the arms 61 is elongate and includes a distal end 62. Each of the distal ends 62 includes a pair of notches 63 for engaging the resilient flexible element 15 for varying the resistance created by a swinging of the pedal 13. The pedal 13 is easier to swing when the resilient or elastic element 15 is engaged in the upper notches closest to distal end 62. The pedal 13 offers more resistance to swinging when the elastic element 15 is engaged in the lower notches.

As shown in FIGS. 2 and 3, a snap pivotal connection 70 provides for a swinging of the pedal 13 relative to the cradle 11. At its lower end 22, on transversely extending portions, the cradle 11 includes a pair of integral tabs or pivot pins 71 extending outwardly from the cradle outer surface 30. A receptor or hole 72 is formed in each of the arms 61 for receiving its respective pivot pin 71. The arms 61 are resiliently drawable away from each other such that, for assembly, the cradle 11 and pedal 13 may be slidable together until the pins 71 snap into their respective holes 72.

Each of the arms 61 includes additional female connectors or holes 73, 74, 75 for receiving the male connector or pivot pin 71 such that the foot exerciser 10 may be adjusted according to patient foot size. Pin placement in hole 73 lengthens the pedal 13. Pin placement in hole 74 raises the pedal 13. Pin placement in hole 75 lowers the pedal 13. This may also be referred to as adjusting the pedaling axis of the exerciser 10.

At its lower end 22, the cradle 11 further includes a pair of integral stops 80 to prevent an acute pivoting of the pedal 13 relative to the cradle 11, which may otherwise unnaturally draw the foot 14 near to the shin 37. Each of the arms 61 includes an abutment edge 81 which abuts the stop 80.

In operation, the lower leg 12 and foot 14 are lowered into the cradle 11 and pedal 13 and secured therein via the straps 36, 53. The elastic element 15 is then positioned in one of the notches 63 of each of the pedal arms 61. If greater resistance is preferred, the lower notches 63 are utilized. If greater leverage, and hence less resistance is preferred, then the upper notches 63 are utilized. Subsequently, as the foot 14 is swung downwardly so as to extend the toes 42 away from the knee 16, the distal ends 62 of the arm 61 pivot away from the cradle 11 to draw the elastic element 15 tightly against the rear outer surface 30 of the cradle 11 to increasingly create resistance as the foot 14 is swung further downwardly. A return swinging of the foot 14 is then facilitated by the elastic element 15, which draws the arms 61 back to the cradle 11 until the arms 61 abut the stops 80.

Such a swinging may be done repeatedly. If desired, a patient may record the number of swings or actuations with a counter. Hence, for the bed or wheelchair-ridden patient, the counter may encourage compliance to a doctor's prescription or instruction. The counter may also help the patient, doctor, or nurse to monitor usage of the device.

The elastic element 15 is preferably a heavy duty rubber band. However, if desired, such a tension means 15 may be replaced by a torsion spring disposed in the pivot connection 70 or by an elastic element extending between the upper end 20 of the cradle and the front end 50 of the pedal 13. It should further be noted that the tension means may be disposed to provide resistance when the foot is pedaled upwardly toward the knee, i.e. an eccentric pedaling. Such a structure may be provided by reversing the cradle 11 and tension means 15 so that the pedal 13 is biased downwardly. This structure is less preferred but may be utilized if desired.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A foot exerciser for being worn on the lower leg below the knee, opposite to the shin, and to the foot, comprising:

a) a cradle for engaging the lower leg between the ankle and the knee;

b) a pedal for engaging the foot, said pedal being hingedly connected to said cradle;

c) a pair of arms affixed to said pedal traversely of each other, each pair of arms extending upwardly from said pedal proximal to said cradle, each of said arms having a plurality of notches; and d) an elastic element adjustably engaged to one of each of said plurality of notches of each of said pair of arms, and to said cradle.

2. The foot exerciser of claim 1, wherein said pedal comprises a first portion for engaging the ball of the foot and a second portion proximal to said cradle wherein said pair of arms are pivotally connected to said cradle.

3. The foot exerciser of claim 2, wherein said pair of arms are elongate and include distal ends, said elastic element engaging said distal ends.

4. The foot exerciser of claim 3, wherein said elastic element extends between said distal ends and about said cradle.

5. The foot exerciser of claim 4, wherein a strap is engaged to said first portion of said pedal where said strap secures said pedal to the foot.

6. The foot exerciser of claim 5, wherein said pedal includes sidewalls to minimize sideways movement of the foot.

7. The foot exerciser of claim 1, wherein said cradle is elongate extending from a position below the knee to a position above the foot.

8. The foot exerciser of claim 7, wherein said cradle includes a second strap engaged to the lower leg.

9. The foot exerciser of claim 8, wherein said cradle includes inner padding for cushioning the lower leg.

10. The foot exerciser of claim 2, wherein said cradle includes a stop against which said pair of arms abut to define a rest position for said foot exerciser.

11. The foot exerciser of claim 1, wherein said pedal is swingable on an axis relative to said cradle, said pedal further comprising means for adjusting the axis.

12. A foot exerciser for being worn on the lower leg and foot, comprising:

a) a cradle for engaging the lower leg between the ankle and knee and having a pair of transversely extending portions;

b) a pedal for engaging the ball of the foot and having a pair of transversely extending portions each of the transversely extending portions having notches;

c) one of the pairs of transversely extending portions being resilient to engage the other pair in a snap arrangement, the pedal being swingable relative to the cradle via the snap arrangement; and d) tension means adjustably engaged to said notches between the cradle and pedal for creating resistance to swinging of the pedal whereby the foot is exercised by a resistance pedaling of the foot.

13. The foot exerciser of claim 12 wherein the snap arrangement includes male and female connectors, one of the transversely extending portions including at least two of one of the connectors whereby an axis of the snap arrangement may be adjusted relative to the ankle of the foot.

14. A foot exerciser for being worn on the lower leg and foot, comprising:

a) a cradle for engaging the lower leg between the ankle and knee and having upper and lower ends and outer and inner surfaces;

b) a pedal for engaging the ball of the foot and being hingedly connectable to the cradle, the pedal having front and rear ends, the pedal further having sidewalls for minimizing sideways movement of the foot;

c) a leg strap engaged with the upper end of the cradle for engaging the lower leg;

d) a foot strap engaged with the front end of the pedal for engaging the foot;

e) a pair of elongate arms extending transversely of each other and upwardly from the rear end of the pedal, each of the arms having a distal end with a pair of notches;

f) an elastic element extending between the arms and confronting the outer surface of the cradle to provide tension between the pedal and the cradle for creating resistance to swinging of the pedal, the elastic element being movable between the notches to vary the resistance;

g) a stop on the cradle for engaging the pedal to stop an upward swinging of the pedal beyond a predefined point; and h) a snap arrangement between the arms and the lower end of the cradle to permit the cradle and pedal to be easily assembled, the snap arrangement also providing for a swingable connection between the cradle and pedal; whereby the foot is exercised by a resistance pedaling of the foot.

* * * * *